United States Patent [19]

Zakharova et al.

[11] 4,238,323

[45] Dec. 9, 1980

[54] METHOD OF AND APPARATUS FOR ELECTRODYNAMIC SEPARATION OF NONMAGNETIC FREE-FLOWING MATERIALS

[76] Inventors: Maia S. Zakharova, zh/m Kommunar 3p, kv. 69; Nikolai G. Polyakov, prospekt Geroev, 33, korpus 1, kv. 65; Viktor N. Lapitsky, zh/m Topol, 14, kv. 6, all of Dnepropetrovsk; Benyamin A. Ioffe, ulitsa Stirnu, 37a, kv. 44; Robert K. Kalnyn, ulitsa Gorkogo, 52, kv. 19, both of Riga; Anatoly V. Krymtsov, ulitsa Progressivnaya, 8, kv. 132, Dnepropetrovsk, all of U.S.S.R.; Vladimir Podolsky, deceased, late of Dnepropetrovsk, U.S.S.R.; by Sergei V. Podolsky, executor; by Natalia V. Podolskaya, executor, both of ulitsa Barrikadnaya, 4, kv. 3, Dnepropetrovsk, U.S.S.R.

[21] Appl. No.: 8,873

[22] Filed: Feb. 2, 1979

[51] Int. Cl.[3] ..... B03C 1/26

[52] U.S. Cl. ..... 209/212; 198/381; 209/636

[58] Field of Search ..... 209/212, 223 R, 225, 209/636; 198/381, 619

[56] References Cited

U.S. PATENT DOCUMENTS

| | | | |
|---|---|---|---|
| 731,038 | 6/1903 | Gates | 209/212 |
| 1,317,992 | 10/1919 | Sekinger | 209/223 R |
| 3,608,718 | 9/1971 | Aubrey et al. | 209/223 R X |
| 3,645,377 | 2/1972 | Zheigur et al. | 198/381 |
| 3,651,439 | 3/1972 | Ioffe et al. | 198/381 X |

*Primary Examiner*—Ralph J. Hill

*Attorney, Agent, or Firm*—Lackenbach, Lilling & Siegel

[57] ABSTRACT

Electrodynamic separation of nonmagnetic free-flowing materials is accomplished by feeding the flow of a material into a region of maximum intensity of a variable nonuniform magnetic field for inducing maximum eddy currents in electrically conducting particles of the material being separated and producing maximum electromagnetic forces which deflect the electrically conducting particles from the direction of feed of the material being separated.

The variable nonuniform magnetic field is generated by an electromagnet having a closed magnetic core with a magnetic air gap defined by pole pieces. The electromagnet pole pieces are symmetrically divergent from the pole axes in a plane substantially perpendicular to the direction of feed of the material being separated.

11 Claims, 11 Drawing Figures

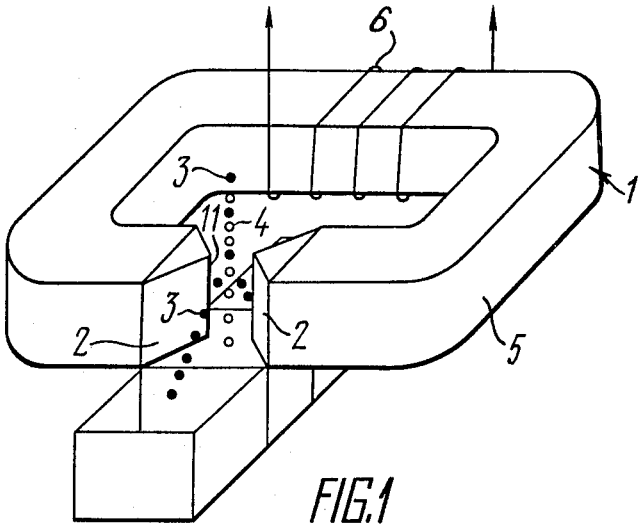
FIG.1
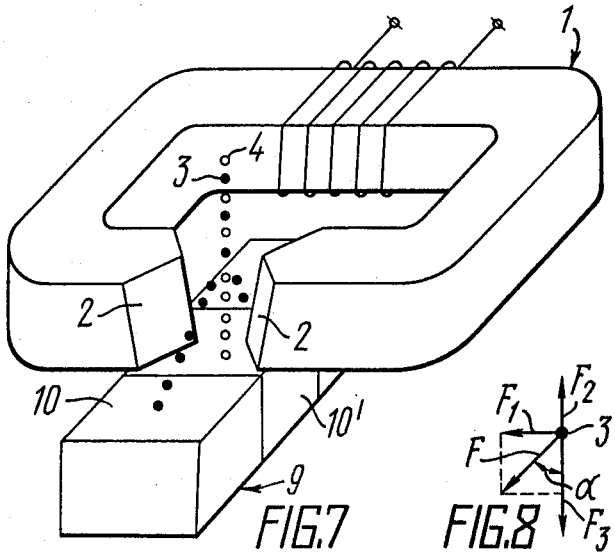
FIG.7
FIG.8

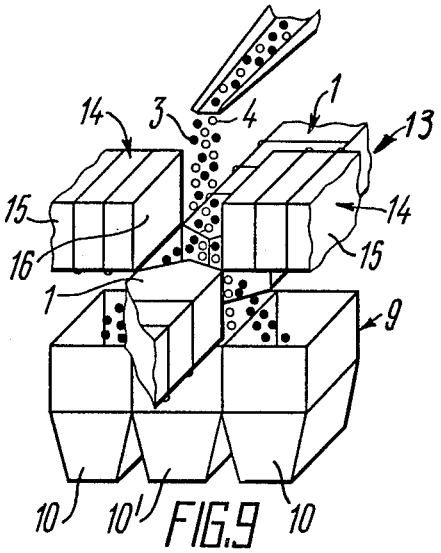
FIG.9
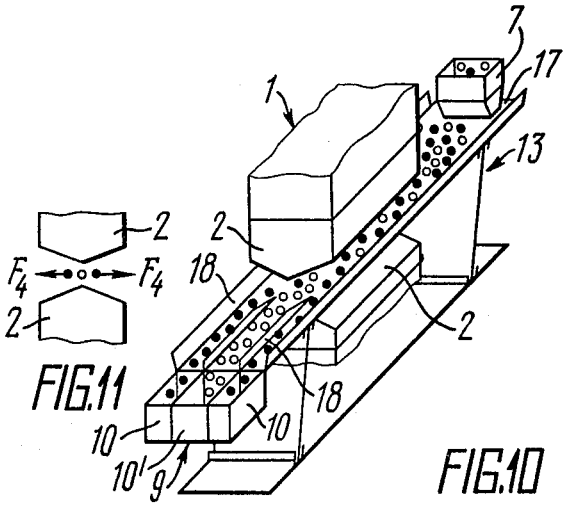
FIG.11
FIG.10

METHOD OF AND APPARATUS FOR ELECTRODYNAMIC SEPARATION OF NONMAGNETIC FREE-FLOWING MATERIALS

BACKGROUND OF THE INVENTION

1. Field of the Invention

The present invention relates to the art of separating materials according to their electromagnetic properties and is specifically concerned with the processes and apparatus for electrodynamic separation and classification of nonmagnetic free-flowing materials according to their electrical conductivity and density.

The invention is particularly useful in beneficiation of auriferous samples in geological practice, in processing auriferous concentrates at concentration plants, or in separation of secondary nonferrous metals at the nonferrous metallurgy enterprises processing industrial wastes. The invention may also be employed for extracting nonferrous metals from solid domestic wastes with subsequent separation of said metals from one another.

2. Description of the Prior Art

It is common knowledge that eddy currents are induced in electrically conducting particles exposed to a variable magnetic field. Interaction of the eddy currents with a variable nonuniform magnetic field produces electromagnetic forces directed towards less intense regions of the magnetic field and causes the electrically conducting particles to move progressively from a region of higher intensity of the magnetic field to a point of a lesser intensity. The magnitude of the forces depends on the specific electrical conductance of the particles, their size and shape, as well as on the magnitude of intensity, degree of nonuniformity, and frequency of the magnetic field.

The above effect is employed in electrodynamic methods for separation of nonmagnetic metalliferous free-flowing materials.

A method and an apparatus for separating nonmagnetic materials whose particles differ in the specific electrical conductance and density are disclosed in U.S. Pat. No. 1,829,565. The separation apparatus comprises a solenoid coil connected to a high-frequency alternating current source. In separating by this method, a flow of freely falling particles being separated is fed close to the coil end. The variable magnetic field of the coil induces eddy currents in the electrically conducting particles moving close to the coil end. Interaction of the variable nonuniform magnetic field of the coil with the eddy currents in the particles produces electromagnetic forces acting on the electrically conducting particles in the direction of decrease in intensity of the coil magnetic field. Force interaction between the eddy currents and the nonuniform magnetic field of the coil results in deflecting the electrically conducting particles from the direction of their free fall, whereas the direction of free fall of electrically nonconducting particles remains unaffected. The flow of particles being separated is thus divided into at least two flows.

It is well known, however, that the intensity of the magnetic field is maximum at the point of intersection of the coil's symmetry axes and declines towards the coil ends. Inasmuch as the particle separation zone is in this case close to the coil end, it is reasonable to say that separation is effected at the magnetic field periphery, i.e., in a region where its intensity is low. Hence, the electromagnetic forces acting upon the particles being separated are weak and the separation quality is poor. Increase in the magnetic field intensity by increasing the current through the coil raises the power consumption and causes an excessive heating of the coil.

Another prior-art method of and apparatus for electromagnetic separation of nonmagnetic free-flowing materials are disclosed in French Pat. No. 2,116,430.

According to this method, a flow of particles of the material being separated is fed to the periphery of a variable magnetic field. This apparatus, called an electrodynamic separator, comprises an electromagnet having an excitation winding connected to an alternating current source and a closed magnetic core with an air gap defined by the electromagnet pole pieces.

The flow of particles of the material being separated is fed into the separation zone, i.e., into the region of variable nonuniform magnetic field, by a drum or a belt conveyor provided for this purpose. In the first case, the electromagnet is installed inside the drum so that the pole pieces are as close to the drum inner surface as possible; in the second case, the conveyor belt carrying the material being separated is arranged above the electromagnet poles.

In both of the above cases, the separation process occurs in the region of weak magnetic field, since the material being separated is spaced apart from the pole pieces (in the first case by the drum wall, and in the second by the conveyor belt).

Owing to the presence of a ferromagnetic magnetic core, the above method and apparatus partly reduce the power consumed for electromagnetic separation; the presence of the magnetic core reduces the current drawn by the excitation winding at the same magnetic field intensity in the separation zone, or in the region through which the flow of particles being separated passes. However, the magnetic field of the electromagnets in the above cases is utilized inefficiently as the major portion of magnetic flux closes in the magnetic air gap and only an insignificant portion of magnetic flux closes through the region where the flow of particles being separated passes, i.e., the magnetic field intensity in the separation zone is much lower than it is in the magnetic air gap between the electromagnet poles.

The presence of the magnetic core with a closed magnetic system in the above apparatus reduces the power consumption, but the throughput rate and separation quality are inadequate due to the fact that the magnetic field intensity in the separation zone is much lower than it is in the gap between the poles. Moreover, an unjustified power consumption is observed.

OBJECTS OF THE INVENTION

An object of the invention is to provide a method of and an apparatus for electrodynamic separation of nonmagnetic free-flowing materials, which make it possible to enhance the efficiency of separation and classification of nonmagnetic free-flowing materials at essentially the same power consumption as that required when employing the prior-art method and apparatus.

A further object of the invention is to provide a method and apparatus which make it possible to enhance the efficiency of electrodynamic separation of high-density electrically conducting particles at essentially the same power consumption.

Still further object of the invention is to provide a method and apparatus which make it possible to enhance the efficiency of electrodynamic separation of spatially asymmetrical particles.

Another object of the invention is to provide a method and apparatus which ensure pre-orientation of spatially asymmetrical particles being separated so that their maximum cross-sectional areas are arranged substantially perpendicularly to the magnetic lines of force of the variable nonuniform magnetic field.

Still another object of the invention is to produce the separation zone in the region of maximum intensity of the magnetic field.

Yet another object of the invention is to enhance the efficiency of separation of nonmagnetic free-flowing materials owing to a lower probability of pushing out electrically nonconducting particles by electrically conducting materials.

SUMMARY OF THE INVENTION

The above and other objects are attained by a method for electrodynamic separation of nonmagnetic free-flowing materials, based on interaction between a variable nonuniform magnetic field and eddy currents in electrically conducting particles of the material being separated. It includes the feed of a flow of the material being separated into a region of maximum intensity of the variable nonuniform magnetic field. According, to the invention, the flow of the material being separated is directed into the region of maximum intensity of the variable nonuniform magnetic field for inducing the maximum eddy currents in the electrically conducting particles which deflect the electrically conducting particles from the direction of feed of the material being separated.

Such a method of electrodynamic separation of nonmagnetic free-flowing materials makes it possible to enhance the efficiency of separating the materials at the same power consumption as that required for the prior-art separation method. This is attained owing to the fact that the separation process is accomplished in the region of maximum intensity of the variable nonuniform magnetic field.

In separating heavy metals, it is preferable to expose the material particles being separated to additional electromagnetic forces directed oppositely in the gravity forces acting on the electrically conducting particles so as to counterbalance the gravity forces and to increase the angle of deflection of the direction of fall of the electrically conducting particles away from a vertical under the action of the main electromagnetic forces. Increasing the angle of deflection of the direction of fall of the electrically conducting particles from a vertical allows the heavier electrically conducting particles to be more efficiently separated from electrically nonconducting particles and particles with a lower specific electrical conductance.

When separating a material containing spatially asymmetrical particles, it is also preferable that the particles before being fed into the region of the maximum intensity of the variable nonuniform magnetic field be oriented in space with their maximum cross-sectional areas substantially perpendicularly to the magnetic lines of force of the variable nonuniform magnetic field. This technique considerably enhances the efficiency of separating spatially asymmetrical particles by creating the conditions for emergence of the maximum possible electromagnetic forces at essentially the same intensity and degree of nonuniformity of the variable magnetic field.

Such an orientation of electrically conducting particles of the material being separated can be accomplished by directing the freely falling flow of the material into a variable uniform magnetic field whose magnetic lines of force are substantially perpendicular in space to the magnetic lines of force of the variable nonuniform magnetic field.

The orientation of electrically conducting particles of the material being separated can also be effected by directing the flow of the material by a vibrating trough disposed in the region of maximum intensity of the variable nonuniform magnetic field. This technique makes it possible to orient the spatially asymmetrical particles substantially in a horizontal plane in the course of their feed.

The above and other objects are also attained by an electrodynamic separator comprising an electromagnet having an excitation winding connected to an alternating current source and having a closed magnetic core with a magnetic air gap defined by pole pieces producing a nonuniform variable magnetic field. Also included are a loading means, a means for feeding a flow of the material being separated into the region of the nonuniform variable magnetic field, and a receiving means to hold the separated material. According to the invention, the electromagnet pole pieces are symmetrically divergent from the pole axis in a plane substantially perpendicular to the direction of the flow of the particles being separated.

Such a construction of the electrodynamic separator enables the energy of the variable magnetic field of the electromagnet to be utilized to the maximum extent owing to concentration of the magnetic field at the center of the magnetic air gap between the pole pieces which allow for passage of the particles being separated in the region of the maximum intensity of the variable magnetic field.

The electromagnet pole pieces may be wedge-shaped with their opposite edges disposed in a vertical plane.

The electromagnet pole pieces may also have curved surfaces of the second degree whose generatrices are to be disposed vertically.

It is useful to arrange the opposite surfaces of the pole pieces with respect to each other at an angle whose vertex points downwards. This arrangement produces an additional electromagnetic force directed oppositely to the gravity forces acting on the particles being separated, which increases the angle of deflection of individual particles from the direction of feed of the initial material and enhances the efficiency of separating heavy electrically conducting particles.

It is good practice to arrange the opposite surfaces of the pole pieces at an angle of from 0° to about 45° with respect to each other. When the pole piece surfaces are arranged at an angle of 0°, no additional electromagnetic force directed oppositely to the particle gravity force is produced. Their arrangement at an angle of 45° considerably reduces the intensity of the variable magnetic field in the top portion of the separation zone.

It is advisable to provide the electromagnetic separator with a means for orientation of spatially assymmetrical particles of the material being separated before feeding them into the region of the maximum intensity of the variable nonuniform field so that the maximum cross-sectional areas of the particles are arranged in space substantially perpendicularly to the magnetic lines of force of said electromagnet. Such an orientation of the spatially asymmetrical particles before feeding them into the region of the maximum intensity of the variable nonuniform field enhances the efficiency of extracting such particles from the initial mixture.

The means for orienting the spatially asymmetrical particles of the material being separated may be placed above said electromagnet and made in the form of an additional electromagnet having a closed magnetic core with a magnetic air gap defined by pole pieces whose opposite planes are parallel to each other and perpendicular in space to the pole axis of said electromagnet.

The means for orienting the spatially asymmetrical particles of the material being separated may also be made in the form of a vibrating trough inclined to a horizontal, disposed between the electromagnet pole pieces, and provided at the material discharge end with ribs serving to divide and guide the material being separated; in this case, the electromagnet has to be installed so that the axis of its poles be arranged in a vertical plane.

BRIEF DESCRIPTION OF THE DRAWINGS

The manner of attaining the above-mentioned and other objects will become more apparent from the description of the proposed method for electrodynamic separation of nonmagnetic materials, from detailed examples of implementing the method, and also from the drawings of the electrodynamic separator, wherein identical parts are denoted by identical reference numerals and wherein:

FIG. 1 illustrates the principle of electrodynamic separation of nonmagnetic free-flowing materials, according to the invention;

FIG. 7 illustrates an electromagnet, wherein the opposite surfaces of its pole pieces are arranged at an angle with respect to each other;

FIG. 8 is a diagram of the principal forces acting on an electrically conducting nonmagnetic particle positioned in the field of the electromagnet shown in FIG. 7;

FIG. 9 representation of the electrodynamic separator with a means for orientation of spatially asymmetrical particles in the form of an additional magnet which, as well as the electromagnet, is partially broken away for a better illustration of the separation zone;

FIG. 10 illustrates of the electromagnetic separator with a means for orientation of spatially asymmetrical particles in the form of a vibratory trough; and FIG. 11 is a diagram of the forces acting on electrically conducting particles positioned in the field of the electromagnet shown in FIG. 10.

DETAILED DESCRIPTION OF THE INVENTION

Proposed herein is a method of electrodynamic separation of nonmagnetic free-flowing materials, based on interaction between a variable nonuniform magnetic field and eddy currents induced in electrically conducting particles of the material being separated.

The method is accomplished by feeding a flow of nonmagnetic free-flowing materials into a region of nonuniform variable magnetic field produced by an alternating-current electromagnet 1 (FIG. 1) with a magnetic air gap defined by pole pieces 2.

According to the invention, the flow of the free-flowing material being separated is fed into a region of maximum intensity of the variable nonuniform magnetic field for inducing in electrically conducting particles 3 the maximum eddy currents deflecting the electrically conducting particles from the direction of feed of nonmagnetic particles 4 of the material being separated.

Figure 2:
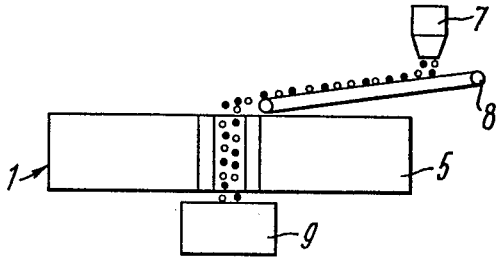
FIG. 2 is a front view of the electrodynamic separator.
Figure 3:
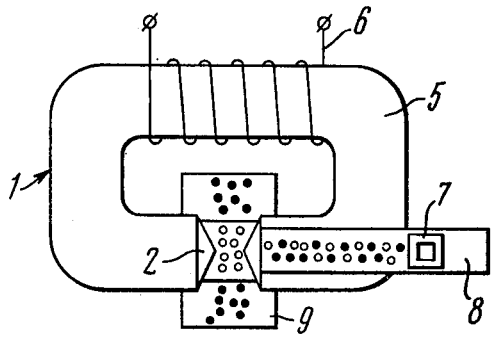
FIG. 3 is a top view of the electrodynamic separators shown in FIG. 2.
Figure 4:
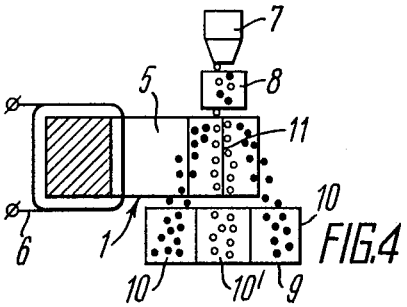
FIG. 4 is a side elevation view of the electrodynamic separators shown in FIG. 2, partially sectionalized to show the direction of motion of the separated material.

The method of electrodynamic separation of nonmagnetic free-flowing materials is effected by an electrodynamic separator. The electrodynamic separator comprises an electromagnet 1 (FIG. 2) which is a magnetic core 5 with an excitation winding 6 connected to a high-frequency alternating-current source (not shown). The magnetic core 5 has a magnetic air gap (FIG. 3) defined by pole pieces 2 (FIGS. 1 and 2) which produce a variable nonuniform magnetic field. The material being separated is fed into the separation zone by the use of a loading means in the form of a hopper 7 and a belt conveyor 8 disposed adjacent thereto. To hold the separated material a receiving means is provided in the form of a hopper 9 divided into sections 10 (FIG. 4), each of the sections being intended to receive the corresponding material.

According to the invention, the pole pieces 2 of the electromagnet 1 (FIGS. 1 and 3) are symmetrically divergent from the pole axis in a plane substantially perpendicular to the direction of feed of the material being separated.

The pole pieces 2 (FIGS. 1 and 3) of the electromagnet 1 are wedge-shaped with their opposite edges 11 (FIGS. 1 and 4) disposed in a vertical plane.

Figure 5:
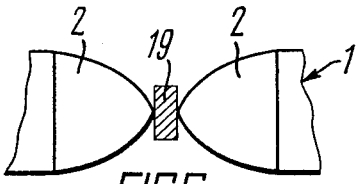
FIG. 5 illustrates pole pieces with convex curved surfaces of the second degree.
Figure 6:
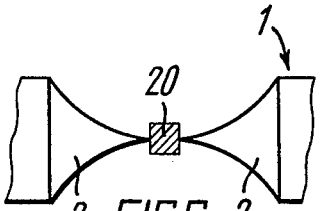
FIG. 6 illustrates pole pieces with concave surfaces.

According to another embodiment of the invention, the pole pieces 2 of the electromagnet 1 have curved surfaces whose generatrices are disposed vertically. FIG. 5 illustrates pole pieces 2 having convex surfaces of the second degree, and FIG. 6 illustrates, pole pieces 2 with concave surfaces of the second degree.

According to still another embodiment of the invention, the opposite surfaces of the pole pieces 2 (FIG. 7) are arranged with respect to each other at an angle of from 0° to about 45° whose vertex points downwards.

The electrodynamic separator has a means 13 (FIG. 9) for orientation of spatially asymmetrical electrically conducting particles of the material being separated, installed above the electromagnet 1 and made in the form of an additional electromagnet 14. The additional electromagnet 14 is installed above the electromagnet 1 and has a closed magnetic core 15 with a magnetic air gap defined by pole pieces 16 whose opposite planes are parallel to each other and perpendicular in space to the axis of the poles of the electromagnet 1.

According to another embodiment of the invention, the means 13 for orientation of spatially asymmetrical particles of the material being separated is essentially a vibratory trough 17 (FIG. 10) having a vibratory drive (not shown). The vibratory trough 17 is disposed between the pole pieces 2 of the electromagnet so that the axis of its poles is oriented perpendicularly to the surface of the trough 17. The end of the vibratory trough 17 in the direction of material discharge is provided with guide ribs 18 arranged substantially parallel to the axis of the vibratory trough 17.

The above-described electrodynamic separator functions as follows.

The initial free-flowing material, which is a mixture of at least two nonmagnetic materials differing in electrical conductance, is delivered from the loading hopper 7 onto the belt of the conveyor 8, which carries the material being separated to the center of the magnetic air gap of the electromagnet 1. The flow of the material being separated freely falls from the belt of the conveyor 8 into the air gap defined between the pole pieces 2 of the electromagnet 1.

Since the pole pieces 2 defining the magnetic air gap are symmetrically divergent from the pole axis, a region of maximum intensity of the nonuniform variable magnetic field is formed in the air gap (i.e., in the separation zone).

Thus, during free fall of the flow of the material being separated, the maximum eddy currents are induced in the particles of the material which differ in electrical conductance, the magnitude of the currents being directly proportional to the specific electrical conductance of a particle.

Interaction between the variable nonuniform magnetic field and the eddy currents induced in the electrically conducting particles produces electromagnetic forces which push the particles toward a less intense portion of the magnetic field.

The particles are deflected from the direction of feed or fall of the material being separated through different angles depending on their electrical conductance and density. Heavier particles and particles with a lower electrical conductance are deflected through a smaller angle, and lighter particles and particles with a higher electrical conductance are deflected through a greater angle.

The use of pole pieces 2 (FIG. 5) with convex surfaces of the second degree is advisable when the throughput rate of separation is to be increased and when no restriction is imposed on the power consumption. With this configuration, an increase in the current through the excitation winding 6 of the electromagnet and the consequent increase of the magnetic induction in the separation zone makes it possible to use a lesser degree of nonuniformity of the variable magnetic field to attain the same magnitudes of the electromagnetic forces in a larger volume.

Concentration of a variable nonuniform magnetic field 19 with a convex shape of the pole pieces is shown in FIG. 5.

FIG. 6 shows concentration of a variable nonuniform magnetic field 20 with the pole pieces 2 having concave surfaces of the second degree. Such a configuration is recommended when a high quality of separation is required with no demands placed upon the throughput rate and the power consumption. Concentration of the magnetic field in the central portion of the magnetic air gap (separation zone) with a high degree of the field nonuniformity is attained in this case with an insignificant increase in the power consumption.

For the wedge-shaped pole pieces 2 (FIG. 1), the above-specified conditions can be attained by varying their wedge angle.

When the opposite surfaces of the pole pieces 2 (FIG. 7) are arranged at an angle with respect to each other, separation of nonmagnetic free-flowing materials occurs as follows.

The variable nonuniform magnetic field induces eddy currents in the electrically conducting particles 3 of the material being separated in the separation zone. Interaction between the variable nonuniform magnetic field with the eddy currents results in the electrically conducting particles 3 being acted upon by two electromagnetic forces (FIG. 8):

$F_1$, conditioned by the magnetic air gap diverging in a plane perpendicular to the flow of the material being separated, and $F_2$, conditioned by the magnetic air gap diverging in the direction opposite to that of the electrically conducting particle gravity force $F_3$.

Interacting with the field, the electrically conducting particles 3, under the action of a resultant force F which is equal to $$F=\sqrt{(F_3-F_2)^2+F_1^2}, \quad (1)$$

are deflected through an angle $\alpha$ and fall into the section 10' for the electrically conducting particles of the receiving hopper 9, while the electrically nonconducting particles 4 freely fall with no deflection from a vertical (i.e. from the direction of feed of the flow being separated) into the appropriate section 10.

Thus, owing to counteraction of the electromagnetic forces $F_2$ to the gravity forces $F_3$, the velocity of fall of heavy particles is slowed down and they care deflected by the resultant force toward a less intense portion of the variable nonuniform magnetic field. Such a separation technique is useful in beneficiation of heavy minerals, such as gold, platinum, etc., i.e., when the separation efficiency greatly depends on the density of the electrically conducting particles.

When the means 13 for orientation of spatially asymmetrical particles in the form of the additional electromagnet 14 is used, the process of separation proceeds as follows. While falling freely the flow of the material being separated enters the magnetic air gap of the additional orienting electromagnet 14, and eddy currents are induced in the electrically conducting particles of the material being separated. Interaction between the eddy currents and the uniform variable magnetic field causes the electrically conducting particles 3 to turn so that their maximum cross-sectional areas become arranged along the magnetic lines of force of the additional orienting electromagnet 14.

While freely falling the flow of the material being separated, whose electrically conducting particles 3 are now oriented in the above manner, enters the magnetic air gap of the electromagnet 1, i.e., gets into the separation zone, or the region of the maximum intensity of the nonuniform variable magnetic field, where separation of the initial material occurs. Owing to the fact that the maximum cross-sectional areas of the particles are arranged substantially perpendicularly to the magnetic lines of force, the maximum eddy currents are induced in the particles. Interaction between the maximum eddy currents and the nonuniform variable magnetic field causes an increase in the electromagnetic forces acting on the particles and hence an increase of the angle of deflection of the electrically conducting particles from the free fall direction and a decrease of the probability of collision of the particles with one another. Thus, the quality of separation of a material with spatially asymmetrical particles is improved, and the throughput rate of separation is increased.

EXAMPLE 1

Finely divided wastes of electrical cables in the form of a copper-lead mixture with a particle size of 2 to 3 mm at a weight ratio of 1:1 was separated. The shape of particles was close to spherical.

Separation was accomplished in an electrodynamic separator whose wedge-shaped pole pieces 2 (FIG. 1) of the electromagnet had a wedge angle of about 135°, the magnetic air gap between the edges of the pole pieces being about 7 mm. The electromagnet excitation winding 6 was fed from a high-frequency current source. The maximum value of magnetic induction at the centre of the magnetic air gap was about 0.07 T.

Electrodynamic separation yielded the following results:

- the copper concentrate contained 99.9% copper and 0.1% lead; and
- the lead concentrate contained 99.4% lead and 0.6% copper.

Separation of the above-specified copper-lead mixture with the use of the pole pieces 2 (FIG. 7) whose opposite surfaces were arranged at an angle of about 10° to each other yielded the same results as in the above-described case, but the appearance of an additional electromagnetic force directed oppositely to the particle gravity forces made it possible to reduce the magnetic induction to 0.06 T, which naturally cut down the power consumption.

EXAMPLE 2

Auriferous mixtures containing, according to the analysis of averaged samples, about 95% gold and 5% associated minerals with a low electrical conductance, such as pyrite, and electrically nonconducting minerals, such as hematite, cassiterite, garnet, scheelite, etc. were separated. The gold particles were predominantly of a splintery nature in the form of disks with a diameter of about 1 to 2 mm.

Separation was accomplished in an electrodynamic separator whose wedge-shaped pole pieces 2 (FIG. 1) of the electromagnet had a wedge angle of about 90°, the magnetic air gap between the edges of the pole pieces 2 being about 4 mm.

The magnetic induction at the center of the magnetic air gap between the pole pieces was 0.07 T.

The extraction of gold into the concentrate by electrodynamic separation amounted to about 24%. Such a low extraction of gold into the concentrate may be attributed to a random orientation of gold particles entering the separation zone.

When the above-specified auriferous mixture was separated in an electrodynamic separator provided with the additional electromagnet 14 (FIG. 9) for orientation of gold particles, the degree of extraction rose to 80% with a content of gold in the concentrate of up to 99.8%.

EXAMPLE 3

Auriferous mixtures containing 74% gold and 36% associated heavy-concentrate minerals with a low electrical conductance were separated. Gold particles were of a splintery and an oblate shape and of 1 to 2 mm in size.

The particles were fed into the separation zone by the vibratory trough 17 (FIG. 9) of the electrodynamic separator.

When being fed by the vibratory trough 17, the particles were repeatedly tossed up, with the result that they became dispersed over the surface of the vibratory trough 17 and their maximum-area surfaces rested on the trough. On reaching the separation zone, the particles became exposed to the action of the electromagnetic forces $F_4$ (FIG. 11) directed perpendicularly to the direction of movement of the material being separated, and a rearrangement of the particles on the vibratory trough 17 took place: gold particles moved to the sides of the vibratory trough 17, while particles of heavy-concentrate minerals, unaffected by electromagnetic forces, concentrated at the central portion of the vibratory trough 17. Thus, as the particles moved further, gold particles were directed into the sections 10 of the hopper for holding electrically conducting particles, and electrically nonconducting particles fell into the section 10'.

EXAMPLE 4

An aluminium-lead mixture with particles 2 to 3 mm in size at a weight ratio of 1:1 was separated. The shape of the particles was close to spherical.

Separation was accomplished in an electrodynamic separator with wedge-shaped pole pieces, the wedge angle being 135°, and the air gap was about 10 mm.

The degree of aluminium extraction by electrodynamic separation was about 99.7%.

EXAMPLE 5

A mixture containing 60% aluminium and 40% zinc was separated. The size of particles in the mixture varied from 2 to 4 mm.

To separate said mixture, the particles were classified into two fractions, from 2 to 3 mm and from 3 to 4 mm.

Separation was accomplished in an electrodynamic separator with the wedge-shaped pole pieces 2, the magnetic air gap therebetween being about 10 mm. The wedge angle of the pole pieces was about 120°.

The maximum induction in the separation zone was 0.04 T in separating the 3 to 4-mm fraction material and 0.048 T in separating the 2 to 3-mm one.

The degree of aluminium extraction amounted to about 98% for the particles of 3 to 4 mm in size and to 96.5% for those of 2 to 3 mm in size.

EXAMPLE 6

Inasmuch as the electromagnetic force acting on an electrically conducting particle in a variable nonuniform magnetic field depends on the particle size, particles of one and the same metal can be classified according to their size.

Thus, classification of spherical aluminium particles of different size, namely of 2 to 6 mm in diameter, was accomplished in an electrodynamic separator whose electromagnet had wedge-shaped pole pieces with a wedge angle of 120°. Separation of the particles according to their size proved to be successful at a maximum magnetic induction of 0.03 T. The maximum curving of the path in passing through the separation zone took place for 6-mm diameter particles, while the path of smaller-size particles, i.e., those with a diameter of up to 2 mm, was almost unaffected, and 3 to 5-mm particles exhibited an intermediate curving of the path, with the result that large-diameter 6-mm particles were collected in the outer sections of the receiving hopper, small-diameter particles were collected in the center section, and intermediate-size particles were collected in the sections adjoining the center one, i.e., disposed between the center section and the outer sections of the receiving hopper.

An averaged degree of concentration of particles according to their size of 97% was attained in each of the sections, respectively.

While particular embodiments of the invention have been shown and described, various modifications thereof will be apparent to those skilled in the art and therefore it is not intended that the invention be limited to the disclosed embodiments or to the details thereof and departures may be made therefrom within the spirit and scope of the invention as defined in the claims.

What is claimed is:

1. A method of electrodynamic separation of nonmagnetic free-flowing materials comprising the steps of:

orienting the materials so their maximum cross-sectional areas are substantially perpendicular to magnetic lines of force of a variable nonuniform magnetic field; and feeding said oriented materials into a maximum intensity region of said variable nonuniform magnetic field, whereby eddy currents are induced in electrically conducting particles of said materials, and interaction between said eddy currents and said magnetic field causes deflection of said electrically conducting particles from said flow of material.

2. A method according to claim 1, wherein the step of orienting said materials includes feeding said materials into a variable uniform magnetic field, wherein magnetic lines of force of said uniform magnetic field are substantially perpendicular to magnetic lines of force of said nonuniform magnetic field.

3. A method according to claim 1, wherein the step of orienting said materials includes positioning said materials on a vibrating trough positioned in said maximum intensity region of said nonuniform magnetic field.

4. An electrodynamic separator of nonmagnetic free-flowing materials, comprising:

an electromagnet generating a variable nonuniform magnetic field, a maximum intensity region of said nonuniform magnetic field being located in a magnetic air gap defined by pole pieces of said electromagnet, said pole pieces being symmetrically divergent from the pole axis in a plane substantially perpendicular to said flow of materials;

means for orienting said materials so their maximum cross-sectional areas are substantially perpendicular to magnetic lines of force of said variable nonuniform magnetic field;

means for feeding said flow of materials into said magnetic air gap, wherein eddy currents are induced in electrically conducting particles of said materials, and interaction between said eddy currents and said magnetic field causes deflection of said electrically conducting particles from said flow of materials; and receiving means for holding the separated materials.

5. An electrodynamic separator according to claim 4, wherein said means for orienting comprises an orienting electromagnet generating a variable uniform magnetic field, wherein said orienting electromagnet includes a magnetic air gap defined by pole pieces whose opposite planes are parallel to each other and perpendicular to said axis of said electromagnet, and said flow of materials passes through said air gap of said orienting electromagnet before it passes through said air gap of said electromagnet.

6. An electrodynamic separator according to claim 4, wherein said means for orienting comprises a vibrating trough diposed in said magnetic air gap, a surface of said vibrating trough being perpendicular to said axis of said poles, and said flow of materials being transferred from said vibrating trough to said magnetic air gap.

7. An electrodynamic separator according to claim 6, wherein a discharge end of said vibrating trough includes guide ribs substantially parallel to said surface of said vibrating trough.

8. An electrodynamic separator according to claim 4, wherein the electromagnet pole pieces are wedge-shaped with their opposite edges disposed in a vertical plane.

9. An electrodynamic separator according to claim 4, wherein the pole pieces of said electromagnet have curved surfaces whose generatrices are disposed in a vertical plane.

10. An electrodynamic separator according to claim 4, wherein the opposite surfaces of the pole pieces are arranged with respect to each other at an angle whose vertex points downwards.

11. An electrodynamic separator according to claim 10, wherein the opposite surfaces of the pole pieces are arranged with respect to each other at an angle of from 0° to 45°.

* * * * *